US006186721B1

(12) United States Patent
Ganter

(10) Patent No.: US 6,186,721 B1
(45) Date of Patent: Feb. 13, 2001

(54) DEVICE FOR PRESSING A BOOK COVER ONTO THE ADHESIVE-COATED OUTER SURFACES OF INNER BOOKS TO BE INSET INTO BOOK COVERS BY MEANS OF AN INSETTING MACHINE

(75) Inventor: Christian Ganter, Biberehren (DE)

(73) Assignee: Grapha-Holding AG, Hergiswil (CH)

( * ) Notice: Under 35 U.S.C. 154(b), the term of this patent shall be extended for 0 days.

(21) Appl. No.: 09/604,030

(22) Filed: Jun. 27, 2000

(30) Foreign Application Priority Data

Jul. 22, 1999 (EP) ..... 99810661

(51) Int. Cl.[7] ..... B42C 13/00
(52) U.S. Cl. ..... 412/22; 412/9; 412/19
(58) Field of Search ..... 412/4, 8, 9, 19, 412/21, 22

(56) References Cited

U.S. PATENT DOCUMENTS 3,469,270 * 9/1969 Thorp ..... 412/22
3,771,185 * 11/1973 Thorp et al. ..... 412/22
4,565,477 * 1/1986 Axelrod .
5,141,377 * 8/1992 Rathert ..... 412/22

FOREIGN PATENT DOCUMENTS 3713896 10/1987 (DE) .
0198201 10/1986 (EP) .

* cited by examiner

*Primary Examiner*—Willmon Fridie, Jr.
(74) *Attorney, Agent, or Firm*—Friedrich Kueffner

(57) ABSTRACT

An arrangement for pressing a book cover onto adhesive-coated outer surfaces of an inner book to be inset into a book cover in an insetting machine, moving inner books on saddle plates of a circulating conveyor vertically upwardly, has a pressing device with two or more pressing rollers positioned opposite one another in an area where a book cover is to be pressed onto the adhesive-coated outer surfaces of the inner book which is moved by a saddle plate. The two pressing rollers each press one side of the book cover onto one of the adhesive-coated outer surfaces of the inner book. The pressing device is coupled by a drive connection to a conveyor of an insetting machine. The drive connection has a pulling element gear unit for continuously adjusting a relative position between the saddle plates and the pressing device.

18 Claims, 4 Drawing Sheets

19
13
17
15
14
20
12
16
18
2
4
21
F

DEVICE FOR PRESSING A BOOK COVER ONTO THE ADHESIVE-COATED OUTER SURFACES OF INNER BOOKS TO BE INSET INTO BOOK COVERS BY MEANS OF AN INSETTING MACHINE

BACKGROUND OF THE INVENTION

1. Field of the Invention

The invention relates to an arrangement for pressing a book cover onto the adhesive-coated outer surfaces of an inner book to be inset into book covers by means of an insetting machine, comprised of two pressing rollers of a pressing device arranged opposite one another with respect to the pressing area, for pressing respectively a side of a book cover onto an adhesive-coated outer surface of an inner book moved vertically upwardly by a saddle plate of a circulating conveyor, wherein the pressing device is connected and controlled by a drive connection to the conveyor.

2. Description of the Related Art

The adjustment of a pressing device relative to the transported inner book in an insetting machine requires a time-consuming labor expenditure and is possible only for stopped machines, as, for example, disclosed in European patent application EP-A-0 198 201 and German patent application DE-A-37 13 896. In this context, the drive of the pressing device must be disconnected from the main drive in order to adjusted the pressing rollers to the width of an inner book transported by the saddle plate.

Insetting machines can have, as is known in the art, more than one pair of pressing rollers wherein the leading pressing roller pair in the conveying direction of the inner book, i.e., the first roller pair acting on an inner book is adjusted to the inner book and the following pressing pair only performs an additional pressing function.

SUMMARY OF THE INVENTION

It is an object of the present invention to eliminate for a precise pressing process the manual adjustment, which entails several additional disadvantages, and to provide for a device of the aforementioned kind apparatus-related measures with which the aforementioned circumstances are eliminated as much as possible during the alignment of the pressing device.

In accordance with the present invention, this is achieved in that the drive connection between the conveyor and the pressing device is provided with an adjustable pulling element gear unit for a continuous adjustment of the relative position between the saddle plates and the position of the pressing device.

In an advantageous embodiment of the invention the pulling element gear unit is comprised of a circulating pulling element, for example, a chain or a toothed belt, that is connected with the conveyor, on the one hand, and the pressing device, on the other hand, in a driving connection. This is a simple assembly measure that can also be realized for already existing machine concepts.

In a preferred embodiment, the circulating pulling element guided about the drive shafts of the conveyor and of the pressing device has two portions and each portion is guided about a stationarily supported roller pair of two laterally spaced apart deflection rollers and a control roller positioned between the deflection rollers and freely rotatably supported on a slide that is moveable on a guide arrangement, wherein each portion forms an open loop extending between the deflection rollers and guided about the control roller.

As an alternative, the pulling element guided about the drive shafts of the conveyor and of the pressing can form two portions which are guided respectively about two spaced apart control rollers of a roller pair, mounted freely rotatably on a slide which is adjustable on a guide arrangement, and a stationarily supported deflection roller thus forming an open loop extending between the control rollers and guided about the deflection roller.

Both configurations of guiding the pulling element do not differ with regard to their effect, but the latter arrangement requires a slide with larger dimensions.

Moreover, it would be possible to supplement the roller pairs as in the situation of a pulley block by additional rollers so that the adjusting process of the slide could be realized with a further reducing action.

Advantageously, the slide is adjustable in the guide arrangement perpendicularly to a plane which extends through the rotational axes of a roller pair so that symmetrical conditions are present.

Expediently, for simplifying the attachment, the guide arrangement for receiving the slide is connected with the frame of the insetting machine.

The slide can be manually driven or driven by a controllable motor wherein the drive is realized mechanically or by a linear drive.

It is favorable when the slide is provided at the side facing away from the deflection rollers or the rollers, with threaded bushings into which a spindle is screwed so that a compact and easily accessible construction is realized.

For a preadjustment of the slide and for tensioning the pulling element, it is advantageous when the control rollers or the roller pairs are supported each on at least one tensioning plate that can be displaced on the slide in the movement direction of the slide.

DESCRIPTION OF THE PREFERRED EMBODIMENTS

Figure 1:
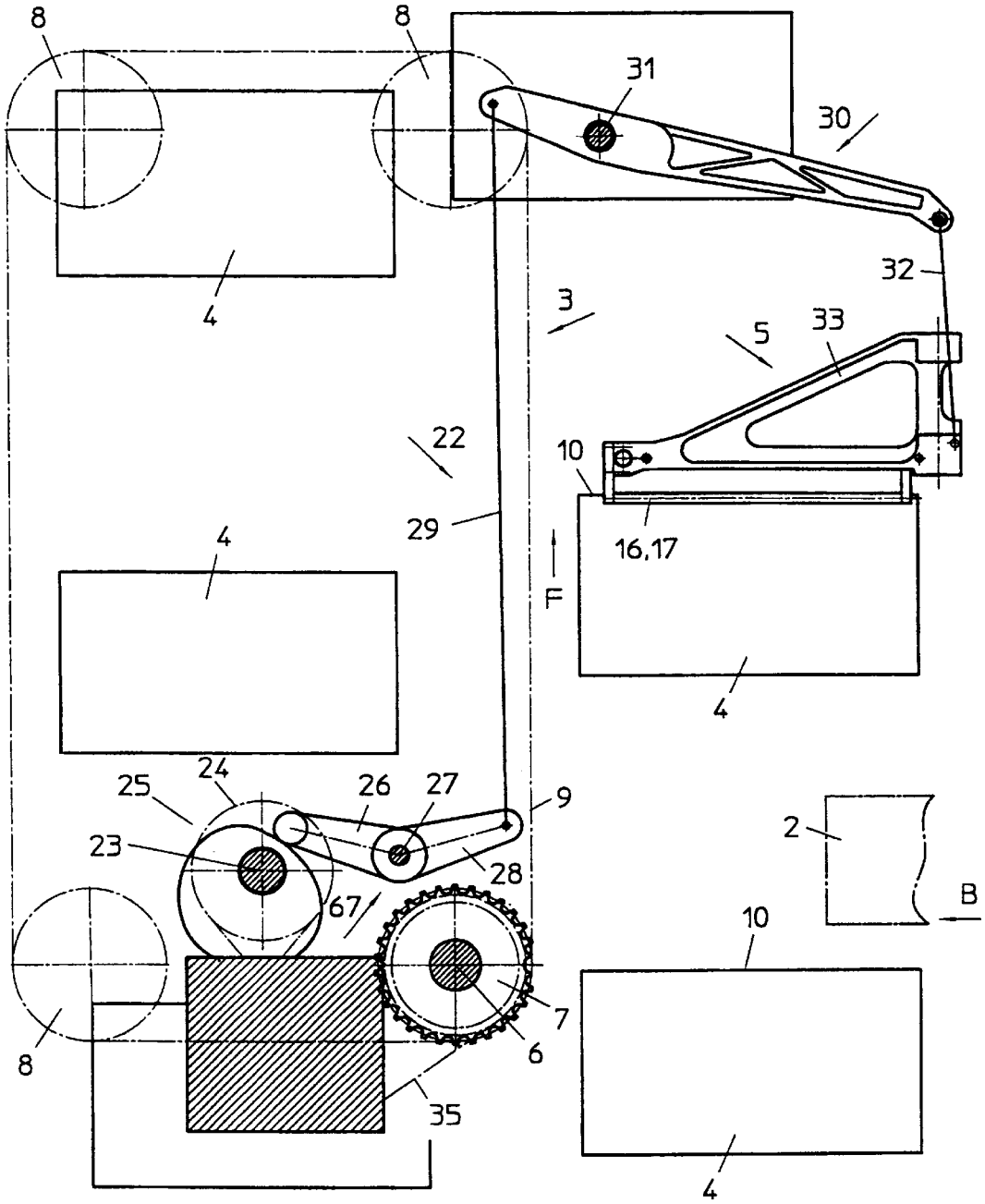
FIG. 1 is a schematically represented pressing device of a book insetting machine.

FIG. 1 shows a device 1 for pressing a book cover (not shown) onto the outer sides of an adhesive-coated inner book which is transported on a vertical portion by a conveyor 3 on a saddle plate 4 through the active area of the pressing device 5. The conveyor 3 comprises a drive wheel 7 fastened onto the drive shaft 6 and three freely rotating deflecting rollers 8 on which the pulling member 9, for example, a chain or a toothed belt, circulate. The saddle plates 4 connected to the pulling member 9 have on their movement path in each position a constant orientation with a horizontal upper edge 10. An inner book to be provided with a book cover is loaded from the side onto the edge 10 of the saddle plate 4 and the inner book is subsequently seated astride on the saddle plate 4. For this purpose, the inner books 2 are positioned, with the open front edge facing downwardly in the direction of arrow B, by means of an inner book divider (not shown), which divides and spreads the inner book centrally, into a receiving position of the conveyor 3 and is transferred onto the saddle plates 4 which penetrate the inner book 2 by moving in the upward direction.

Initially, the inner books 2 suspended from the saddle plates 4 pass through an adhesive application area (not shown) where both outer sides are supplied with an adhesive by the adhesive application device.

Figure 2:
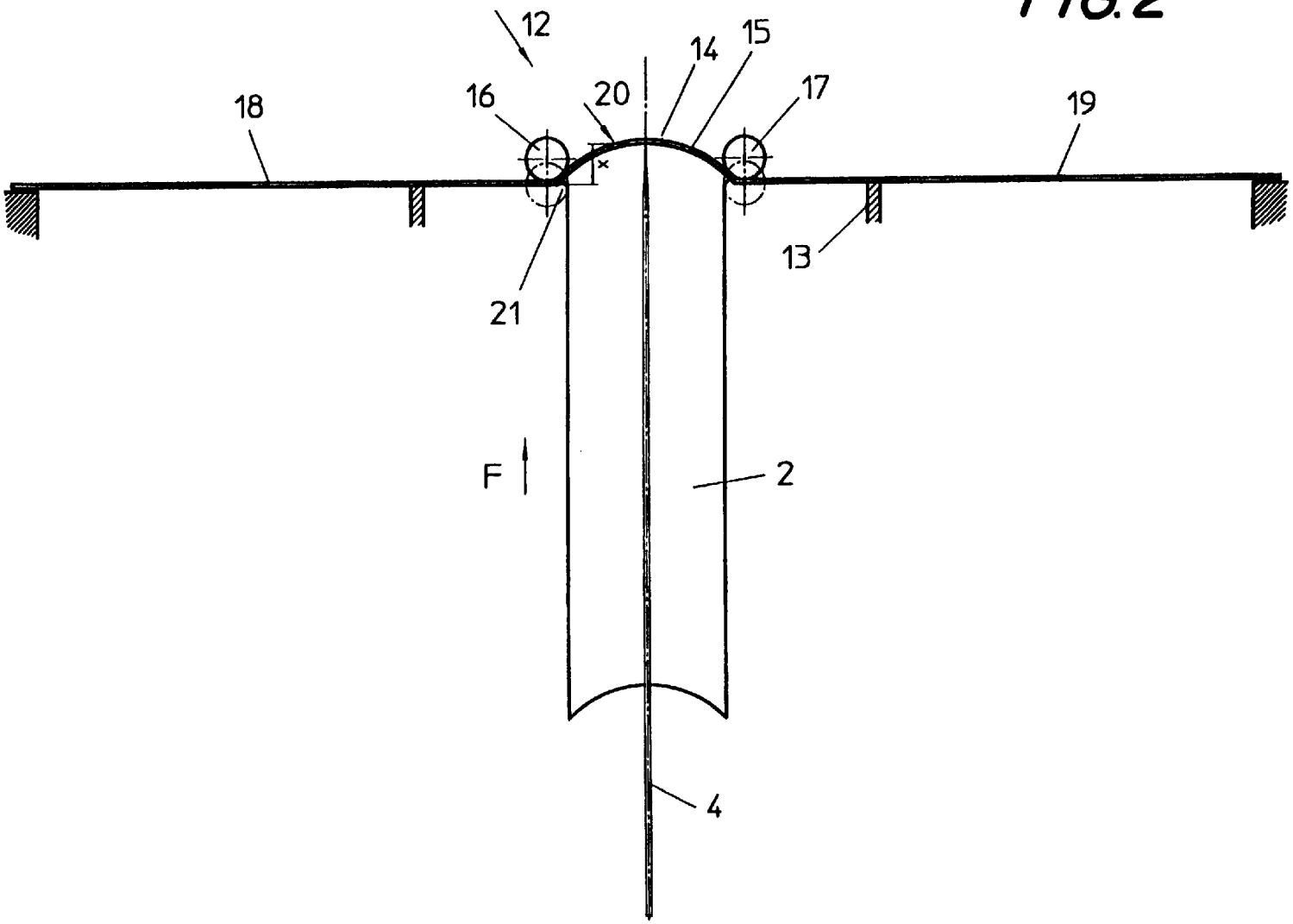
FIG. 2 shows a cross-section of a portion of the conveyor of a book insetting machine in front of, respectively, within the pressing area of the pressing device.

Before an inner block 2 that has been coated on the sides with the adhesive reaches the pressing device 5 (pressing station) arranged above the adhesive application device, the book cover 12 is supplied from the side perpendicularly to the upward movement path of the inner book 2 such that it comes to rest uniformly distributed on the book back or spine 14, respectively, on the saddle plate 4. This situation is shown in FIG. 2 where an inner book 2 having a rounded back has just reached the initial position for the pressing process of a rounded book cover 12. The book cover 12 is positioned on both sides of the saddle plate 4 on cover supports 13. The continuously circulating saddle plates 4 of the conveyor 3 bring the inner book back 14 into the vicinity of the book cover 12 at the rounded spine portion 15, i.e., bring it into a contact position at spine 15. Upon contact, the pressing device 5 moves in the upward direction with a speed that increases to the same speed as that of the conveyor 3.

The spacing of the inner book back 14 to the spine 15 of the book cover 12 can be selected such that the inner book 2, when starting the pressing device, is more or less immersed in the book cover 12.

Subsequently, the pressing device 5 is controlled such that its movement is reversed so that the pressing rollers 16, 17, while the cover sides 18, 19 are lifted off the cover supports 13 and are pivoted downwardly, press the cover 12 onto the mushroom-shaped projection and the cover sides 18, 19 onto the adhesive-coated inner book 2 by a rolling action. For this purpose, the pressing rollers 16, 17 are laterally supported with spring action in order to be able to overcome the mushroom-shaped projection without damage.

Due to the variable shoulder spacing X, i.e., the spacing between the inner book back 14 and the groove 21 resulting from the mushroom-shaped pressing action, the movements of the pressing device 5 must be adjusted to the different cross-sectional shapes in the area of the inner book back.

In the case of a straight inner book or book back, the same method is applied.

The drive of the pressing device 5 is realized by a lever transmission 22 connected to the drive shaft 6 of the conveyor 3. It comprises according to FIG. 1 a shaft 23 to which are connected a drive wheel 24 of the lever transmission 22 and a rotary control member 25 providing a control path for actuating the control lever 67. The free end of a lever arm 26 rests by means of a control roller on the control member 25. The lever arm 26 is connected fixedly with a lever arm 28 positioned opposite the pivot axis 27, thus forming a control lever 67. A connecting rod 29 is connected with one end to the free end of the lever arm 28 and with the other end to one end of a rocker arm 30. Oppositely arranged to the pivot axis 31 of the rocker arm 30, the rocker arm 30 is coupled by a guide rod 32 with a support frame 33 of the pressing device 5. The pressing rollers 16, 17 are supported on the support frame 33. The drive shaft 6 of the conveyor 3 and the shaft 22 of the lever transmission 22 are connected by a pulling element gear unit 34 illustrated as a black box and shown in more detail in FIGS. 3 and 4. Instead of a cumbersome adjustment of the control member 25 on the shaft 23, a rotary angle adjustment can be performed during standstill as well as during operation of the machine by using the pulling element gear unit 34 or by means of a servo control between the drive shaft 6 of the conveyor 3 and the shaft 23 of the lever transmission 22.

The drive connection between the drive shaft 6 of the conveyor 3 and the drive wheel 24 on the shaft 23 is realized by means of a pulling element 35, for example, in the form of a chain 40 or a toothed belt. The rounded end of an inner book back 2 determines during the pressing action the shape of the mushroom-like projection and the spacing of the groove from the inner book back as well as the shape of the spine when using the book. It is therefore important that the movement of the pressing rollers of the pressing device is adjusted in an optimal manner to different cross-sections within the spine area and to changing positions of the grooves.

Figure 3:
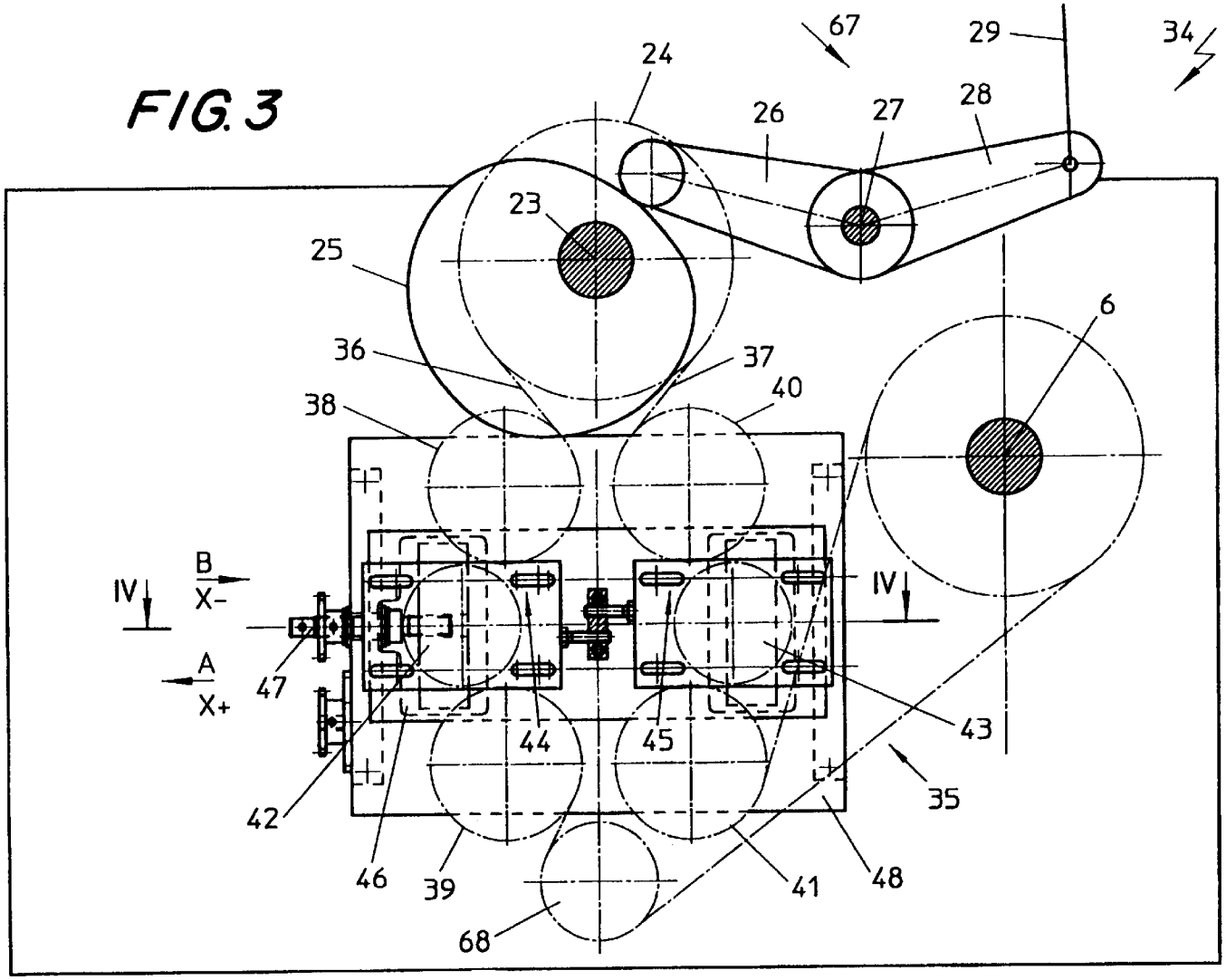
FIG. 3 is a view of the pulling element gear unit of the device.
Figure 4:
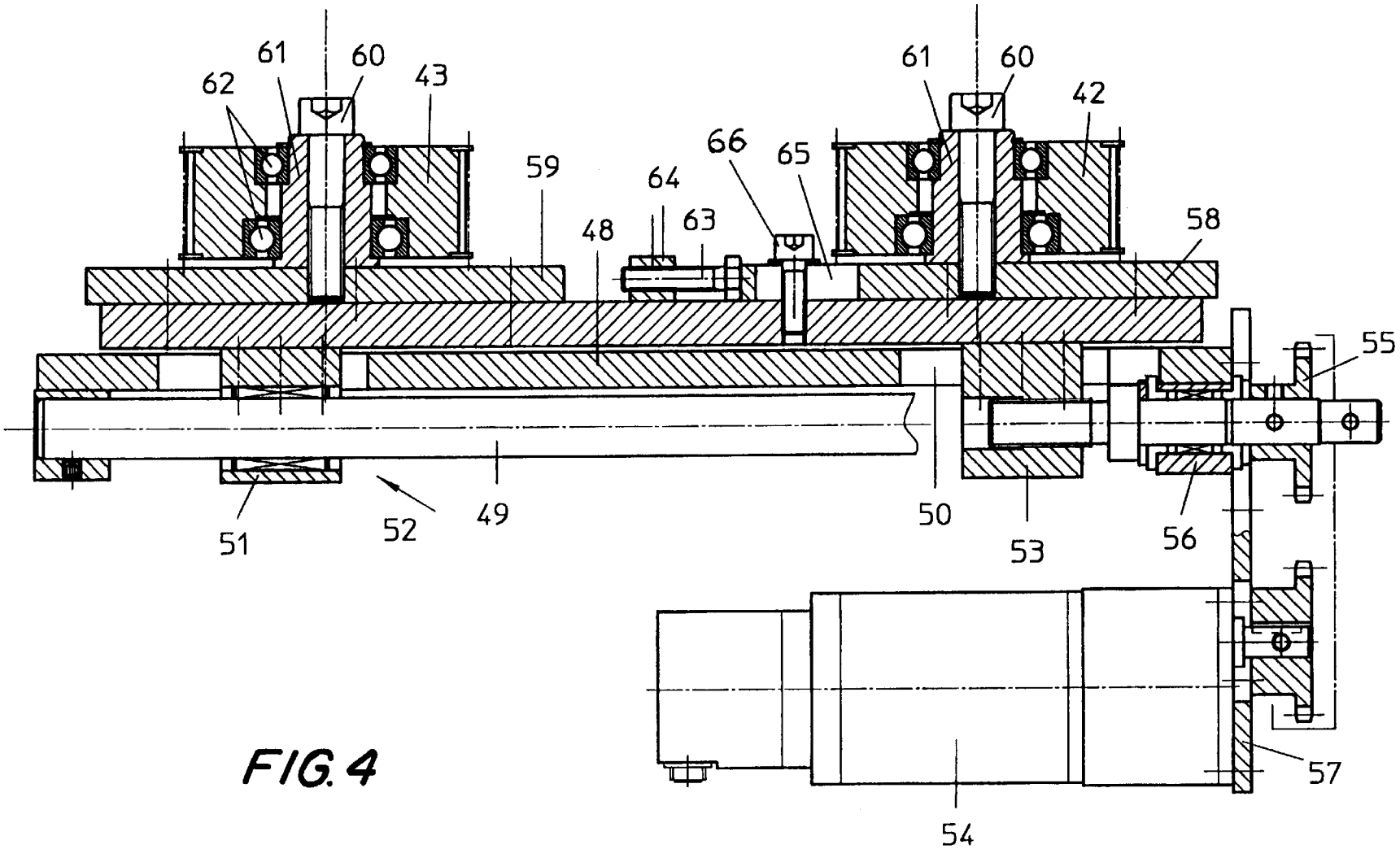
FIG. 4 is a cross-sectional view of the pulling element gear unit according to section line IV—IV of FIG. 3.

The FIGS. 3 and 4 show a possible embodiment of the pulling element gear unit 34 interposed in the drive connection between the conveyor 6 and the pressing device 5 (see also FIG. 1). A toothed wheel 7 is seated on the drive shaft 6 of the conveyor 3 and is partially embraced at the driving side by the pulling element 35 and is also drivingly connected to a toothed wheel 24 fastened on the shaft 23 of the lever transmission 22 of the pressing device 5. The shafts 6 and 23 divide the pulling element 35 into two portions 36, 37, having correlated therewith respectively a stationary roller pair of laterally spaced apart deflection rollers 38, 39 and 40, 41 as well as an adjustable control roller 42, 43 arranged therebetween. Between the deflection rollers 38 through 41 and the control rollers 42, 43 the portions 36, 37 of the pulling element 35 have oppositely positioned open loops 44, 45, whose length can be adjusted by the adjustable control rollers 42, 43.

The length change of the portions 36, 37 of the pulling element 35 can effect between the cycle-synchronized shafts 6, 23 a continuous phase displacement which provides an optimal adjusting and changing of the pressing rollers 16, 17 of the pressing device 5 relative to the mushroom-shaped cross-sectional shape of the area of the inner book back, even during operation of the machine. As explained with the aid of the directional arrows A, B in FIG. 3, upon actuation of the slide 46 by means of the threaded spindle 47 in the direction X+ an elongation of the pulling element portion 36 and a shortening of the pulling element portion 37 occur, and this causes a phase displacement between the rotary angles of the shaft 23 and the drive shaft 6. An actuation of the slide 46 in the counter direction X-provides an opposite phase displacement between the drive shaft 6 and the shaft 23.

The phase displacement could also be realized with an electric shaft on the drive shaft 6 and/or the shaft 23. However, this appears to be uneconomical at the present time.

Of course, in the inventive arrangement the pulling element portions 36, 37 could also be guided about the outer circumferential portion of the deflecting rollers 38 through 41, so that the loops formed by the control rollers 42, 43, have open ends facing away from one another. This results in control rollers 42, 43 being positioned closer to one another while the roller pairs 38, 39; 40, 41 are positioned farther apart. All rollers 38 through 41 are freely rotatable, and the deflecting rollers 38 through 41 are supported on a plate 48, which is fixedly connected to the frame (not shown) of the inner book insetting machine, and the control rollers 42, 43 are supported on a slide 46 movable in a plane perpendicular to the axes of the deflection roller pairs 38, 39 and 40, 41. At the side of the plate 48 facing away from the rollers 38 through 41, parallel guide rods 49 are fastened, which extend on either side of the longitudinal center axis of the slide 46 and on which the slide 46 is moved. For this purpose, the slide 46 is provided with supports 52 having bearing bushings 51 each penetrating the plate 48 in a respective cutout 50, thus forming a follower 53, through which the threaded spindle 47 extends which has at its other end a chain wheel 55 connected to a gear motor 54. The threaded spindle 47 is supported on a support 56 fastened to the plate 48, and the gear motor 54 is fastened to a holder 57 connected to the plate 48. For adjusting or tensioning the pulling element 35 in the form of a toothed belt, the control rollers are supported respectively on tensioning plates 58, 59 which can be moved in the movement direction of the slide 46 and can be locked. For this purpose, the control rollers 42, 43 are fastened on a bearing pin 61 fastened by a screw 60 to the tensioning plate 58, 59. Deep groove ball bearings 62 are seated on the bearing pins 61 for supporting the toothed wheels 42, 43. The tensioning of the toothed belt 35 is realized by a respective tensioning screw 63 which is positioned with its head at the inner end face of the tensioning plates 58, 59 viewed in the movement direction and is adjustably screwed into a bar 64 that is mounted on the slide 46 and positioned between the tensioning plates 58, 59. The tensioning plates 58, 59 each have four guide slots 65 which are each penetrated by a fastening screw 66 fastened to the slide 46 and provided with a washer under the screw head.

In order to provide a space-saving arrangement of the pulling element gear unit 34 between the drive shaft 6 of the conveyor 3 and the shaft 23 of the lever transmission 22 of the pressing device 5 in an already existing inner book insetting machine, a further stationery deflection roller 68 is provided.

While specific embodiments of the invention have been shown and described in detail to illustrate the inventive principles, it will be understood that the invention may be embodied otherwise without departing from such principles.

What is claimed is:

1. An arrangement for pressing a book cover onto adhesive-coated outer surfaces of an inner book to be inset into a book cover in an insetting machine, moving inner books on saddle plates of a circulating conveyor vertically upwardly, the device comprising:

a pressing device comprising two or more pressing rollers positioned opposite one another in an area where a book cover is to be pressed onto the adhesive-coated outer surfaces of the inner book being moved by a saddle plate;

the two pressing rollers configured to each press one side of the book cover onto one of the adhesive-coated outer surfaces of the inner book;

the pressing device configured to be coupled by a drive connection to a conveyor of an insetting machine;

the drive connection comprising a pulling element gear unit configured to continuously adjust a relative position between the saddle plates and the pressing device.

2. The arrangement according to claim 1, wherein the pulling element gear unit comprises a pressing device drive shaft configured to drive the pressing device, and wherein the pulling element gear unit comprises a circulating pulling element configured to be connected to a conveyor drive shaft of the conveyor and to the pressing device drive shaft.

3. The arrangement according to claim 2, further comprising a controlled lever transmission configured to connect the pressing device drive shaft to the pressing device.

4. The arrangement according to claim 2, wherein the pulling element gear unit comprises a slide moveably mounted on a guide arrangement, a first pair of stationary, spaced apart first deflecting rollers positioned externally to the slide and a first control roller mounted freely rotatingly on the slide and positioned between the first deflecting rollers, and a second pair of stationary, spaced apart second deflecting rollers positioned externally to the slide and a second control roller mounted freely rotatingly on the slide and positioned between the second deflecting rollers, wherein the pulling element has a first portion guided about the first deflecting rollers and the first control roller to form a first open loop and has a second portion guided about the second deflecting rollers and the second control roller to form a second open loop.

5. The arrangement according to claim 4, wherein the first and second open loops of the first and second portions of the pulling element are configured to be length-adjusted by moving the slide.

6. The arrangement according to claim 5, wherein the slide is configured to be moved on the guide arrangement in a plane perpendicular to the axes of the deflecting rollers.

7. The arrangement according to claim 4, wherein the guide arrangement is configured to be connected to a frame of the insetting machine.

8. The arrangement according to claim 4, further comprising a controllable motor connected to the slide.

9. The arrangement according to claim 8, further comprising a threaded bushing, connected to a side of the slide opposite the first and second control rollers, and a threaded spindle received in the threaded bushing and connected to the controllable motor.

10. The arrangement according to claim 4, further comprising at least one tensioning plate moveably mounted on the slide, wherein the control rollers are supported on the at least one tensioning plate, and wherein the at least on tensioning plate is configured to be movable relative to the slide for adjusting a position of the slide or for tensioning the pulling element.

11. The arrangement according to claim 2, wherein the pulling element gear unit comprises a slide moveably mounted on a guide arrangement, a first pair of spaced apart control rollers mounted on the slide and a first stationary deflecting roller positioned between the first pair of spaced apart control rollers externally to the slide, and a second pair of spaced apart control rollers mounted on the slide and a second stationary deflecting roller positioned between the second pair of the spaced apart control rollers externally to the slide, wherein the pulling element has a first portion guided about the first deflecting roller and the first pair to form a first open loop and has a second portion guided about the second deflecting roller and the second pair to form a second open loop.

12. The arrangement according to claim 11, wherein the first and second open loops of the first and second portions of the pulling element are configured to be length-adjusted by moving the slide.

13. The arrangement according to claim 12, wherein the slide is configured to be moved on the guide arrangement in a plane perpendicular to the axes of the deflecting rollers.

14. The arrangement according to claim 11, wherein the guide arrangement is configured to be connected to a frame of the insetting machine.

15. The arrangement according to claim 11, further comprising a controllable motor connected to the slide.

16. The arrangement according to claim 15, further comprising a threaded bushing, connected to a side of the slide opposite the first and second pairs, and a threaded spindle received in the threaded bushing and connected to the controllable motor.

17. The arrangement according to claim 11, further comprising at least one tensioning plate moveably mounted on the slide, wherein the first and second pairs are supported on the at least one tensioning plate, and wherein the at least one tensioning plate is configured to be movable relative to the slide for adjusting a position of the slide or for tensioning the pulling element.

18. The arrangement according to claim 1, wherein the pressing device, viewed in the conveying direction of the inner book, has at least two pairs of the pressing rollers spaced apart from one another, wherein the leading pair of the pressing rollers is configured to be adjusted for changing the position of the saddle plates and the pressing device.

* * * * *